United States Patent [19]

Iwasaki et al.

[11] Patent Number: 5,030,552

[45] **Date of Patent: * Jul. 9, 1991**

[54] METHOD FOR PREPARATION OF PHOTOGRAPHIC SILVER HALIDE EMULSIONS AND PHOTOGRAPHIC MATERIALS CONTAINING SAME

[75] Inventors: Nobuyuki Iwasaki; Sumito Yamada; Hiroyuki Mifune, all of Kanagawa, Japan

[73] Assignee: Fuji Photo Film Co., Ltd., Kanagawa, Japan

[ * ] Notice: The portion of the term of this patent subsequent to Jul. 7, 2004 has been disclaimed.

[21] Appl. No.: 370,061

[22] Filed: Jun. 1, 1989

Related U.S. Application Data

[63] Continuation of Ser. No. 860,397, May 7, 1986, abandoned.

[30] Foreign Application Priority Data

May 7, 1985 [JP] Japan ..... 60-96237

[51] Int. Cl.[5] ..... G03C 1/005

[52] U.S. Cl. ..... 430/567; 430/569; 430/599; 430/607; 430/609

[58] Field of Search ..... 430/569, 607, 608, 599, 430/567

[56] References Cited

U.S. PATENT DOCUMENTS

| | | | |
|---|---|---|---|
| 3,957,490 | 5/1976 | Libeer et al. | 430/569 |
| 4,329,417 | 5/1982 | Nagatani et al. | 430/599 |
| 4,399,215 | 8/1983 | Wey | 430/569 |
| 4,665,012 | 5/1987 | Sugimoto et al. | 430/569 |
| 4,665,017 | 5/1987 | Mifune et al. | 430/606 |
| 4,678,745 | 7/1987 | Yamada et al. | 430/608 |
| 4,681,838 | 7/1987 | Mifune et al. | 430/608 |

*Primary Examiner*—Charles L. Bowers, Jr.
*Assistant Examiner*—Lee C. Wright
*Attorney, Agent, or Firm*—Sughrue, Mion, Zinn Macpeak & Seas

[57] ABSTRACT

The present invention provides (1) a method for preparation of a photographic silver halide emulsion containing tabular silver halide particles having a particle diameter larger than the particle thickness by three times or more, wherein least one oxidizing agent selected from a hydrogen peroxide, a salt of a peroxy acid and an ozone is added to the emulsion before the termination of chemical ripening thereof and then a reducing agent is added thereto, and (2) a silver halide photographic material which has at least one or more layers comprising a tabular silver halide particle-containing emulsion wherein tabular silver halide particles are those prepared by method (1). The present tabular silver halide particle-containing emulsion has high sensitivity and good granularity and is substantially free from fog.

18 Claims, No Drawings

METHOD FOR PREPARATION OF PHOTOGRAPHIC SILVER HALIDE EMULSIONS AND PHOTOGRAPHIC MATERIALS CONTAINING SAME

This is a continuation of application Ser. No. 06/860,397, filed 5/7/86, now abandoned.

FIELD OF THE INVENTION

The present invention relates to silver halide photographic materials, and in particular, relates to a novel method for preparation of a photographic silver halide emulsion containing tabular silver halide particles having a particle diameter larger than the particle thickness by three times or more, and to a silver halide photographic material containing the tabular silver halide particle-containing emulsion prepared by the novel method.

BACKGROUND OF THE INVENTION

It has been well known to enlarge the particle size of silver halide particles in a silver halide emulsion in order to increase the sensitivity of the silver halide particle-containing emulsion. However, fog is apt to become significant or the granularity of the silver halide particles often becomes worse with the increment of the particle size of the silver halide particles.

Tabular silver halide particle-containing emulsions are better than other emulsions containing silver halide particles of other shapes with respect to the ratio of sensitivity/granularity, as described in Japanese Patent Application (OPI) No. 58-113926 (the term "OPI" as used herein refers to "unexamined published patent application"). However, when, in order to further increase the sensitivity of the tabular particle-containing emulsion, the particle size of such tabular particles is enlarged, the granularity of the particles becomes worse. It is therefore extremely important to develop a novel method for improving the sensitivity of tabular silver halide particle-containing emulsions without changing the particle size of the silver halide particles and without deteriorating the granularity thereof.

SUMMARY OF THE INVENTION

One object of the present invention is to provide a method for preparation of a tabular silver halide particle-containing emulsion which has high sensitivity and good granularity and which is free from fog, without increment of the particle size of the particles; and to provide silver halide photographic materials containing the tabular silver halide particle-containing emulsions.

Another object of the present invention is to provide a method for preparation of a tabular silver halide particle-containing emulsion having not only high sensitivity, good granularity, and minimized fog but also good storage stability.

The present inventors have extensively investigated various matters, and accordingly have now achieved the present invention. The present invention provides a novel method for preparation of a photographic silver halide emulsion containing tabular silver halide particles having a particle diameter larger than the particle thickness by three times or more, wherein at least one oxidizing agent selected from a hydrogen peroxide, a salt of a peroxy acid, and ozone is added to the emulsion before the termination of chemical ripening thereof, and then a reducing agent is added thereto. In another aspect, the present invention is directed to a novel silver halide photographic material which has at least one or more layers comprising the tabular silver halide particle-containing emulsion.

DETAILED DESCRIPTION OF THE INVENTION

Hydrogen peroxide (or an aqueous solution thereof) to be used in the present invention may be in the form of an adduct of hydrogen peroxide, for example, including $NaBO_2.H_2O_2.3H_2O$, $2Na_2CO_3.3H_2O_2$, $Na_4P_2O_7.2H_2O_2$, $2Na_2SO_4.H_2O_2.2H_2O$, etc. Salts of peroxy acids to be used in the present invention include, for example, $K_2S_2O_8$, $K_2C_2O_6$, $K_4P_2O_8$, $K_2[Ti(O_2)C_2O_4].3H_2O$, $4K_2SO_4.Ti(O_2)OH.SO_4.2H_2O$, $Na_3[VO(O_2)(C_2O_4)_2.6H_2O]$ and peracetic acid. In particular, hydrogen peroxide or adducts thereof are especially preferred among the present oxidizing agents. These oxidizing agents are mostly commercially available and may easily be synthesized.

The amount of the oxidizing agent to be used in the present invention is determined depending upon factors such as the time of the addition thereof and the condition of the addition thereof, and is preferably $10^{-6}$ to 10 moles, more preferably $10^{-4}$ to 1 mole, per mole of silver halide.

In the present invention, the silver halide emulsion is prepared through conventional steps including a precipitation step, (optionally a physical ripening step), a water-washing step, and a chemical ripening step.

The time when the present oxidizing agent is to be added may be in any step before the termination of chemical ripening of the silver halide emulsion, and in any of a precipitation step, a physical ripening step, a water-washing step and a chemical ripening step. In particular, the addition of the oxidizing agent is preferably carried out in any of a precipitation step, a physical ripening step and a chemical ripening step, and more preferably carried out in a chemical ripening step.

When the oxidizing agent is reacted in the method of the present invention, the reaction may be carried out in the presence of a catalyst such as a metal salt (for example, a tungsten salt (e.g. sodium tungstate, tungsten trioxide, etc.), a vanadium salt (e.g. pervanadic acid, vanadium pentaoxide, etc.), an osmium salt (e.g. osmium tetraoxide), a molybdenum salt, a manganese salt, an iron salt, a copper salt, etc.), selenium dioxide, or an enzyme (e.g., catalase). The catalyst may be added to the silver halide emulsion prior to the addition of the present oxidizing agent, or it may be added simultaneously with or after the addition of the oxidizing agent. In general, the catalyst is used in an amount of 10 mg to 1 g per mole of Ag. (Hereafter "per mole of Ag" is referred to as "/mole-Ag.")

As a stabilizer for the hydrogen peroxide used in accordance with the present invention may be used phosphoric acid, barbituric acid, urea, acetanilide, hydroxyquinoline, sodium pyrophosphate, sodium stannate, etc.

The present oxidizing agent is dissolved in water or in a water-soluble organic solvent (such as alcohols, ethers, glycols, ketones, esters and amides) and the resulting solution is added to the emulsion.

In the method of the present invention, a reducing agent is used for the purpose of deactivating an excess amount of the oxidizing agent used, and the reducing agent is a compound capable of reducing hydrogen peroxides, salts of peroxy acids, and ozone. For instance, preferred reducing agents are sulfinic acids such as aromatic or aliphatic sulfinic acids and derivatives thereof (e.g., benzenesulfinic acid, sodium p-toluenesulfinate, sodium octanesulfinate, sodium pentanesulfinate, sodium dodecanesulfinate, and derivatives thereof), di- or tri-hydroxybenzenes (e.g., resorcinol, catechol, gallic acid, 2,3-dihydroxynaphthalene, and derivatives thereof), chromans (e.g., chroman, spirochroman, etc.), tocopherols (e.g., α-tocopherol, γ-tocopherol, etc.), hydrazines and hydrazides (e.g., N-formyl-p-methylhydrazine, etc.), p-phenylenediamines (e g., p-phenylenediamine, etc.), aldehydes (e.g., glutaraldehydebisulfite, etc.), aminophenols (e.g., N-methylaminophenol, etc.), enediols (e.g., ascorbic acid, etc.), oximes (e.g., glyoxime, dimethylglyoxime, salicylaldoxime, etc.), reducing sugars such as monosaccharides and disaccharides (e.g., glucose, saccharose, etc.), phenidones, sulfites, hydrogen gas, etc.

Especially preferred compounds are sulfinic acids, di- or tri-hydroxybenzenes, enediols, oximes and reducing sugars.

The reducing agent is preferably added not less than 10 seconds, and more preferably 1 minute or more, after the addition of the oxidizing agent to be used, and the addition is particularly preferably made during the chemical ripening step or on the termination of the chemical ripening step.

The amount of the reducing agent to be added varies depending upon the amount of the oxidizing agent used and the degree of deactivation of the oxidizing agent, and in general, an equimolar or more, preferably an equimolar to tenfold molar amount, to the amount of the oxidizing agent used, of a reducing agent is used.

Addition of a tenfold or higher molar amount of reducing agent with respect to the amount of the oxidizing agent used, is not preferred, as often resulting in the occurrence of fog with the lapse of time, when the emulsion is preserved.

The stability of the emulsion is improved by the addition of the reducing agent.

In case an excess amount of an oxidizing agent remains in the emulsion, the sensitivity of the emulsion extremely lowers due to the oxidation reaction of the oxidizing agent, when the emulsion is preserved for a long period of time in a refrigerator after the chemical ripening thereof.

In addition, the sensitivity of the emulsion also often decreases when the emulsion is dissolved so as to coat on a photographic support and kept in the form of sol for a long period of time. Moreover, the variation of the sensitivity and fog is often remarkable in the chemical ripening of the emulsion.

By the addition of the present reducing agent after the addition of the oxidizing agent, the variation of the sensitivity and fog can be substantially inhibited.

It has heretofore been known to use an oxidizing agent in the preparation of a silver halide emulsion. In the manufacture of photographic materials for heat-development, for instance, it is known to use an oxidizing agent in a step of halogenation where a silver halide is prepared from a silver carboxylate by the use of a halogen-releasing type oxidizing agent. In addition, it is also known to add an oxidizing agent for the prevention of fog, in the manufacture of silver halide emulsions or photographic materials for heat-development. For instance, the use of oxidizing agents is described in Japanese Patent Publication Nos. 53-40484 and 54-35488 and Japanese Patent Application (OPI) Nos. 52-4821, 49-10724, and 49-45718. However, the object, the action and the effect of the oxidizing agents to be used in an emulsion comprising conventional spherical or the like silver halide particles are quite different from the use, the object, the action and the effect of the present oxidizing agents to be used in the emulsion of the present invention comprising tabular silver halide particles.

The tabular silver halide particles to be used in the present invention are explained in detail hereunder.

The tabular silver halide particles to be used in the present invention have a ratio of diameter/thickness of 3/1 or more, preferably are in a range of from 5/1 to 50/1, and more preferably are in a range of from 5/1 to 20/1.

The "diameter" of the silver halide particles, as used herein, indicates the diameter of a circle having an area equal to the projected area of the silver halide particle (projected from the top). In the present invention, the tabular silver halide particles to be used preferably have a diameter of from 0.3 to 5.0 μm, and more preferably from 0.5 to 3.0 μm.

The thickness of the particles is preferably 0.4 μm or less, more preferably 0.3 μm or less, and most preferably 0.2 μm or less.

In general, the tabular silver halide particles are those comprising two parallel surfaces, and therefore, the thickness of the particles used herein designates the distance between the two parallel surfaces to constitute the tabular silver halide particles.

The tabular silver halide particles to be used in the present invention may comprise any halogen constitution, for example, including silver bromide, silver iodobromide, silver iodochlorobromide, silver chlorobromide and silver chloride. In particular, silver bromide and silver iodobromide are preferred among them, and especially silver bromide and silver iodobromide containing up to 30 mole % of silver iodide are more preferred.

The present emulsion may be any of an internal latent image-type tabular particle-containing emulsion or a surface latent image-type tabular particle-containing emulsion, and the latter is especially preferred.

For the preparation of the present tabular silver halide particles, various techniques known in this technical field may suitably be combined.

For instance, tabular silver halide particle-containing emulsions are described, for example, in "Evolution of the Morphology of Silver Bromide Crystals during Physical Ripening" by Cagnac and Chateau, published in *Science et Industrie Photography,* Vol. 33, No. 2 (1962), pp. 121–125; *Photographic Emulsion Chemistry,* by Duffin, published by The Focal Press, New York, (1966), pp. 66–72; *Photographic Journal,* by A. P. H. Trivelli and W. F. Smith, Vol. 80, page 285 (1940), etc. These may easily be prepared, referring to the methods as described, e.g., in Japanese Patent Application (OPI) Nos. 58-127921, 8-113972, and 58-113928.

For instance, a seed crystal containing 40% by weight or more of tabular particles is formed in an atmosphere having a relatively low pBr value, for example, of 1.3 or less, and then silver and a halogen-containing solution are simultaneously added, while the pBr value is kept in a same degree, and the seed crystal is grown larger, to obtain the tabular silver halide particles of the present invention.

In the step for the growth of the particles, the silver and halogen-containing solution are preferably added so that formation of new crystal nuclei do not occur.

The size of the tabular silver halide particles may be regulated by selecting and controlling the temperature during the formation thereof, the kind and the amount of the solvent to be used, and the addition speed of the silver salt and halide to be used in the growth of the particles.

In the preparation of the tabular silver halide particles in the present invention, a solvent for silver halides may be used, whereby the particle size, the particle shape (ratio of diameter/thickness, etc.), the particle size distribution and the growing speed of particles may be suitably controlled.

For instance, by increasing the amount of solvent used the particle size distribution can be narrowed and the growing speed of the particles can be accelerated. On the other hand, the thickness of the particles is apt to increase with increments in the amount of solvent used.

In the preparation of the tabular silver halide particles in the present invention, it is preferred to accelerate or increase the addition speed, the amount to be added or the added concentration of a silver salt solution (such as $AgNO_3$ aqueous .solution) and a halide solution (such as KBr aqueous solution) for the purpose of accelerating the growth of the particles.

For the means, various disclosures as given, e.g., in British Patent 1,335,925, U.S. Pat. Nos. 3,672,900, 3,650,757, and 4,242,445 and Japanese Patent Application (OPI) Nos. 55-142329, 55-158124, 58-113927, 58-113928, 58-111934, and 58-111936 include descriptions thereof.

The tabular silver halide particles of the present invention may be chemically sensitized, if desired.

For such chemical sensitization, various means may be utilized, for example, including a so-called gold-sensitization with a gold compound (as described in U.S. Pat. Nos. 2,448,060 and 3,320,069), a sensitization with a metal such as iridium, platinum, rhodium or palladium (as described in U.S. Pat. Nos. 2,448,060, 2,566,245, and 2,566,263), a sulfur-sensitization with a sulfur-containing compound (as described in U.S. Pat. No. 2,222,264) or a reduction-sensitization with a tin-containing salt or a polyamine (as described in U.S. Pat. Nos. 2,487,850, 2,518,698, 2,521,925) or a combination of two or more of the means.

The tabular silver halide particles of the present invention are especially preferably sensitized by gold-sensitization or sulfur-sensitization by combination thereof, particularly in view of economization of silver to be used.

As to the layer containing the tabular silver halide particles of the present invention, the tabular particles are preferably contained in the layer in an amount of 40% by weight or more, and especially 60% by weight or more, with respect to the amount of the total silver halide particles contained in the layer.

The thickness of the layer containing the present tabular silver halide particles is preferably from 0.3 to 5.0 μm, and especially preferably from 0.5 to 3 0 μm.

The amount of the tabular silver halide particles to be coated (per one surface of the support) is preferably from 0.5 to 6 g/m$^2$, and especially preferably from 1 to 4 g/m$^2$.

The emulsion layer of the silver halide photographic material of the present invention may further contain conventional silver halide particles in addition to the tabular silver halide particles.

The photographic emulsions which can be used in the present invention may be prepared in accordance with methods as described in *Chimie et Physique Photographique,* by P. Glafkides, published by Paul Montel Co., (1967); *Photographic Emulsion Chemistry,* by G. F. Duffin, published by The Focal Press Co., (1966); *Making and Coating Photographic Emulsions,* by V. L. Zelikman et al., published by The Focal Press Co., (1964), etc.

Any silver halide may be used in the present invention, including silver bromide, silver iodobromide, silver iodochlorobromide, silver chlorobromide, and silver chloride.

In the step for the formation of silver halide particles or for the physical ripening of the silver halide particles, a cadmium salt, a zinc salt, a lead salt, a thallium salt, an iridium salt or a complex salt thereof, a rhodium salt or a complex salt thereof or an iron salt or a complex salt thereof may be co-used. In addition, the additional silver halide particles may optionally be chemical-sensitized, if desired, as in the case of the tabular silver halide particle.

Various kinds of compounds may be incorporated in the photographic emulsion, which contains the plate-like silver halide particles of the present invention, for the purpose of prevention of fog or of stabilization of the photographic characteristics of photographic materials during the formation, preservation or photographic treatment of the material. For instance, various kinds of known fog inhibitors or stabilizers may be used therefor, including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines; thioketo compounds such as oxazolinethione; azaindenes such as triazaindenes, tetrazaindenes (especially 4-hydroxy-substituted-(1,3,3a,7)-tetrazaindenes), pentazaindenes, etc.; benzenethiosulfonic acids, benzene-sulfinic acids, benzenesulfonic acid amides, etc. For example, compounds as described in U.S. Pat. Nos. 3,954,474 and 3,982,947 and Japanese Patent Publication No. 52-28660 may be used.

The photographic emulsion containing the tabular silver halide particles of the present invention is especially preferably spectrally sensitized with methine dyes or the like sensitizing dyes.

Sensitizing dyes which may be used therefor are cyanine dyes, merocyanine dyes, complex cyanine dyes, complex merocyanine dyes, holopolar-cyanine dyes, hemicyanine dyes, styryl dyes, and hemioxonole dyes. Especially useful dyes among them are cyanine dyes, merocyanine dyes and complex merocyanine dyes. These dyes may have any basic heterocyclic nucleus which is conventionally contained in general cyanine dyes, including pyrroline, oxazoline, thiazoline, pyrrole, oxazole, thiazole, selenazole, imidazole, tetrazole and pyridine nuclei; fused nuclei comprising the heterocyclic nucleus and an alicyclic hydrocarbon ring; and fused nuclei comprising the heterocyclic nucleus and an aromatic hydrocarbon ring, such as indolenine, benzindolenine, indole, benzoxazole, naphthoxazole, benzothiazole, naphthothiazole, benzoselenazole, benzimidazole and quinoline nuclei. These nuclei may be substituted on the carbon atoms.

Merocyanine dyes and complex merocyanine dyes may contain a ketomethylene structure-containing 5- or 6-membered heterocylcic ring nucleus such as a pyrazolin-5-one, thiohydantoin, 2-thiooxazolidine-2,4-dione, thiazolidine-2,4-dione, rhodanine, or thio-barbituric acid nucleus.

These sensitizing dyes may be used singly or in the form of a mixture thereof, and the use of a combination of the sensitizing dyes is often preferred for the purpose of supersensitization.

The present photographic emulsion may further contain other dyes which themselves have no spectral-sensitization activity or other substances which do not substantially absorb any visible ray but have supersensitization activity, together with the above-mentioned sensitizing dyes. For example, aminostilbene compounds which are substituted by a nitrogen-containing heterocyclic ring (as described, e.g., in U.S. Pat. Nos. 2,933,390 and 3,635,721); aromatic organic acid/formaldehyde condensation products (as described, e.g., in U.S. Pat. No. 3,743,510); and cadmium salts and azaindene compounds may be added to the photographic emulsion for the purpose. The combinations as described in U.S. Pat. Nos. 3,615,613, 3,615,641, 3,617,295, and 3,635,721 are especially useful.

The photographic emulsion layer of the photographic material of the present invention may contain a color-forming coupler. The couplers are compounds capable of coloring by oxidation-coupling with an aromatic primary amine developing agent (such as a phenylenediamine derivative or an aminophenol derivative) in a color-development treatment, for example, including a magenta coupler such as a 5-pyrazolone coupler, pyrazolobenzimidazole coupler, a cyanoacetyl-chroman coupler, an open-chain acylacetonitrile coupler, etc.; a yellow coupler such as an acylacetamide coupler (e.g. benzoylacetanilides, pivaloylacetanilides), etc.; and a cyan coupler such as a naphthol coupler, a phenol coupler, etc. These couplers are preferably non-diffusive, having a hydrophobic group as a so-called ballast group in the molecule. These couplers may be either 4-equivalent or 2-equivalent to silver ion. In addition, these couplers may so-called DIR-couplers (development inhibitor releasing couplers) which may release a development inhibitor during development.

Besides the DIR couplers, a non-coloring DIR-coupling compound may be included, which may form a colorless reaction product after coupling, and which may release a development inhibitor during development.

The other constituents of the emulsion layer of the silver halide photographic material of the present invention described above are not specifically limited, and various additives may be added thereto, if desired. For instance, binders, surfactants, dyes, ultraviolet ray-absorbents, hardeners, coating aids, tackifiers, plasticizers, etc., as described in *Research Disclosure,* Vol. 176, pp. 22–28, December, 1978, may be incorporated in the photographic materials of the present invention.

The photographic material of the present invention preferably has a surface-protective layer on the outermost surface of the material, which essentially comprises a natural high molecular weight substance or a synthetic high molecular weight substance such as a gelatin substance or a water-soluble polyvinyl compound or acrylamide polymer (as described, e.g., in U.S. Pat. Nos. 3,142,568, 3,193,386, and 3,062,674).

The surface-protective layer may further contain, in addition to the gelatin or high molecular weight substance, a surfactant, an antistatic agent, a matting agent, a lubricant, a hardener, a tackifier, etc.

The photographic material of the present invention may further contain, if desired, an intermediate layer, a filter layer, an antihalation layer, etc.

In the manufacture of the photographic materials of the present invention, the photographic emulsion layers and other additional layers are coated on a flexible support which is generally used in conventional photographic materials, such as a plastic film, paper or cloth. Examples of preferred flexible supports are semi-synthetic or synthetic high molecular weight films such as cellulose nitrate, cellulose acetate, cellulose acetatebutyrate, polystyrene, polyvinyl chloride, polyethylene terephthalate (PET), polycarbonate, etc.; and papers coated or laminated with a baryta layer or an $\alpha$-olefin polymer (such as polyethylene, polypropylene, ethylene/butene copolymer), etc. The supports may be colored with dyes or pigments. As the case may be, the supports may be colored in black for the purpose of lightshielding. The surface of the support is, in general, pre-coated with a subbing layer, for the purpose of improving the adhesiveness with the photographic emulsion layer to be coated thereon. In addition, the surface of the support may optionally be subjected to corona-discharge, ultraviolet-ray irradiation or firing-treatment, before or after the coating of the subbing layer.

In the present invention, the means for coating the tabular particle-containing emulsion layer and the surface-protective layer on the support is not specifically limitative, and a multi-layer simultaneous coating method is preferably utilized for the coating means, as described, e.g., in U.S. Pat. Nos. 2,761,418, 3,508,947, and 2,761,791.

The layer constitution of the photographic materials of the present invention includes various embodiments, for example, as follows:

(1) A layer containing the tabular silver halide particles of the present invention is coated on a support, and then a surface-protective layer comprising gelatin is coated thereon.

(2) A layer containing the tabular silver halide particles of the present invention is coated on a support; and then a silver halide emulsion layer containing spherical or polyhedral silver halide particles (in the case of polyhedral particles, the ratio of diameter/thickness is 3/1 or less) which have a relatively large particle size (0.5–3.0 $\mu$m) and high sensitivity is coated thereon; and thereafter a surface-protective layer comprising gelatin is further coated thereon.

(3) A layer containing the tabular silver halide particles of the present invention is coated on a support; and then plural silver halide emulsion layers are coated thereon; and thereafter a surface-protective layer of gelatin is further coated thereon.

(4) One silver halide emulsion layer is first coated on a support; a layer containing the tabular silver halide particles of the present invention is coated thereon; another silver halide emulsion layer of high sensitivity is further coated thereon; and then a surface-protective layer of gelatin is still further coated thereon, in this order.

(5) A layer containing an ultraviolet absorbent or a dye, a layer containing the tabular silver halide particles of the present invention, another silver halide-containing emulsion layer and a gelatin-containing surface-protective layer are coated on a support in this order.

(6) A layer containing tabular silver halide particles of the present invention and an ultraviolet absorbent or a dye, another silver halide-containing emulsion layer and a gelatin-containing surface-protective layer are coated on a support in the order listed.

In these embodiments, the silver halide-containing emulsion layers may be coated on both surfaces of the support. The silver halide-containing emulsion layer to be coated on the support is not necessarily only one, but plural silver halide-containing emulsion layers may be coated thereon, each having been spectral-sensitized in a different wavelength.

The silver halide photographic materials of the present invention include, for example, black-and-white photographic materials such as X-ray photographic materials (for indirect X-ray or direct X-ray photography), lith-type photographic materials, black and white printing papers, black and white negative films and silver salt-diffusive photographic materials, and color photographic materials such as color negative films, color reversal films, color papers, and color diffusion-transfer photographic materials.

Any known means and known treating solutions may be applied for the photographic treatment of the photographic materials of the present invention, say as described, e.g., in *Research Disclosure,* Vol, 176, pp. 28–30, RD No. 17643, December, 1978. The photographic treatment may be any of a silver image-forming photographic treatment (or black-and-white photographic treatment) or a color image-forming photographic treatment (or color photographic treatment), in accordance with the object of the photographic material to be treated. The temperature in the treatment is selected between 18° C. to 50° C., or the temperature may be lower than 18° C. or may be higher than 50° C.

The developer to be used for the black and white photographic treatment of the present photographic material may contain a known developing agent. Examples of the developing agents are dihydroxybenzenes (such as hydroquinone), 3-pyrazolidones (such as 1-phenyl-3-pyrazolidone), aminophenols (such as N-methyl-p-aminophenol), etc., and these may be used singly or in the form of a mixture of two or more thereof. The developers further contain conventional additives such as a preservative, an alkaline agent, a pH buffer, an antifogging agent, etc.; and in addition, may optionally contain, if desired, a solubilization aid, a color-toning agent, a development accelerator (such as a quaternary salt, a hydrazine, a benzyl alcohol), a surfactant, an antifoaming agent, a water-softener, a hardener (such as glutaraldehyde), a tackifier, etc.

Regarding the development treatment, the present invention may include a special type, such as wherein a developing agent is incorporated in a photographic material, for example, in an emulsion layer, and the photographic material is treated in an alkaline aqueous solution to achieve the development of the material. Regarding the development agents which may be used in the system, hydrophobic agents may be incorporated in the emulsion layer of the photographic material, in accordance with various means, as described, e.g., in *Research Disclosure,* Vol. 169, RD No. 16928, May, 1978, U.S. Pat. No. 2,739,890, British Patent 813,253 and German Patent 1,547,763. The development treatment may be combined with silver salt-stabilization treatment which is carried out with a thiocyanate.

Any conventional fixing solution may be used for the photographic material of the present invention. As a fixing agent, thiosulfates, thiocyanates, and other organic sulfur-containing compounds which are known to have an activity as a fixing agent may be used. The fixing solution may contain a water-soluble aluminum salt as a hardener.

Conventional means may be used for the formation of color images in the photographic materials of the present invention, for example, including a negative-positive method (as described, e.g., in *Journal of the Society of Motion Picture and Television Engineers,* Vol. 61, pp. 667–701 (1953)); a color reversal method where a photographic material is first developed with a developer solution containing a black-and-white developing agent to form a negative silver image, and then this is subjected to at least one uniform exposure and other pertinent fogging-treatment and thereafter subjected to color development treatment, to finally obtain a color positive image; and a silver image-bleaching method where a dye-containing photographic emulsion layer is exposed to light and developed to form a silver image, and then the dye is bleached with the silver image as bleaching catalyst.

The color developer solution generally comprises an alkaline aqueous solution containing a color-developing agent. As the color-developing agent, a known primary aromatic amine developing agent may be used, for example, including phenylenediamines (such as 4-amino-N,N-diethylaniline, 3-methyl-4-amino-N,N-diethylaniline, 4-amino-ethyl-N-$\beta$-hydroxyethylaniline, 3-methyl-4-amino-N-ethyl-N-$\beta$-hydroxyethylaniline 3-methyl-4-amino-N-ethyl-N-methanesulfoamidoethylaniline, 4-amino-3-methyl-N-ethyl-N-$\beta$-methoxyethylaniline), etc.

In addition to the above compounds, those as described in *Photographic Processing Chemistry,* by L. F. A. Mason, published by the Focal Press Co., 1966, pp. 226–229, U.S. Pat. Nos. 2,193,015 and 2,592,364, and Japanese Patent Application (OPI) No. 48-64933 may also be used.

The color developing solution may additionally contain, if desired, a pH buffer, a development inhibitor, an antifogging agent, a water-softener, a preservative, an organic solvent, a development accelerator, a carboxylic acid-type chelating agent, etc.

Examples of these additives are described, e.g., in *Research Disclosure,* RD-17643, December 1978, U.S. Pat. No. 4,083,723 and German Patent Application (OLS) No. 2,622,950.

The present invention is explained in greater detail by reference to the following examples, which, however, are not intended to be interpreted as limiting the scope of the present invention.

EXAMPLE 1

(1) Preparation of tabular particles for comparison

Potassium bromide, thioether ($HO(CH_2)_2S(CH_2)_2$—$S(CH_2)_2OH$) and gelatin were blended and dissolved and the resulting solution was kept at 60° C.; and a silver nitrate-containing solution and a mixture solution containing potassium iodide and potassium bromide were added thereto by the double-jet method, while stirring.

After the completion of the addition, the mixture solution was cooled to 35° C. and soluble salts were removed out therefrom by sedimentation method, and then, the whole was again heated up to 40° C., and 60 g of gelatin was added thereto and dissolved, and the pH value of the reaction solution was adjusted to 6.8. Thus, tabular silver halide particles were formed.

The formed tabular silver halide particles had an average diameter of 0.78 μm, a thickness of 0.145 μm, a ratio of average diameter/thickness of 5.38/1 and a silver iodide content of 3 mole %. pAg at 40° C. was 8.95.

Thus formed emulsion was subjected to chemical ripening by combination of gold-sensitization and sulfur-sensitization, at 56° C. for 100 minutes, This emulsion was called Emulsion-A.

(2) Preparation of tabular particles for comparison

In the same manner as in the above preparation (1), with the exception that the temperature of the solution (60° C.) was changed to 70° C., another silver halide particle-containing emulsion was obtained. The tabular particles formed had an average diameter of 1.25 μm, a thickness of 0.15 μm and a ratio of diameter/thickness of 8.33/1. This emulsion was subjected to the same chemical-ripening as in the above Emulsion-A. This emulsion was called Emulsion-B.

(3) Preparation of tabular particles for comparison

In the same manner as in the above preparation (1), soluble salts were removed out by a sedimentation method to obtain an emulsion. Next, 3.5 wt %-hydrogen peroxide solution (5 cc/mole-Ag; corresponding to $5.15\times10^{-3}$ mole/mole-Ag) was added to the emulsion, and then this was subjected to chemical-ripening by a combination of gold-sensitization and sulfur-sensitization, at 56° C. for 100 minutes.

In this case, the optimum chemical sensitization condition varied, and the amount of the gold-sensitizer used as twice of that used in the preparation of the above (1). This emulsion was called Emulsion-C.

(4) Preparation of tabular particles of the present invention

In the same manner as in the preparation of Emulsion-C, two other emulsions designated as Emulsion-D and Emulsion-E were obtained, except that 1 g/mole-Ag of sodium p-toluenesulfinate was added to the emulsion on the termination of the chemical ripening (Emulsion-D) and 2 g/mole-Ag of the sulfinate was added thereto (Emulsion-E).

(5) Preparation of coated samples

Each of the Emulsion-A through Emulsion-E (gel) was dissolved (i.e., converted into sol) at 40° C., and 500 mg/mole-Ag of a sensitizing dye of anhydro-5,5'-dichloro-9-ethyl-3,3'-di(3-sulfopropyl)oxacarbocyanine-hydroxide-sodium salt and 200 mg/mole-Ag of potassium iodide were added thereto for green-sensitization. In addition, 4-hydroxy-6-methyl-1,3,3a,7-tetrazaindene (stabilizer), 2,6-bis(hydroxyamino)-4-diethylamino-1,3,5-triazine, polyacrylamide having an average molecular weight of 47,000, a coating aid, and a hardener were added thereto. Each of these emulsion was coated on a PET-support together with a surface-protective layer component, by co-extrusion. The thickness of the surface-protective layer was 1.2 μm and the amount of the coated silver was 2.5 g/m$^2$.

Using each of Emulsion-A through Emulsion-E, three samples were formed; a first was formed by coating the emulsion immediately after chemical ripening, a second was formed by coating the emulsion after the emulsion was preserved for 4 weeks in a refrigerator at 8° C., and a third was formed by coating the emulsion which was dissolved and preserved at 40° C. for 8 hours after the chemical ripening thereof.

(6) Evaluation of photographic characteristics and granularity

Each sample formed in the above formation (5) was uniformly green-exposed with a filter in which the side of a shorter wavelength than 480 nm was cut off. After the exposure, the sample was developed with the following Developing Solution-A at 20° C. for 4 minutes, and then fixed with the following Fixing Solution-B and thereafter washed with water.

The results are given in the following Table-1, where the relative sensitivity was calculated on the basis of the amount of exposure required for obtaining the density of a fog value +1.0, taking the sensitivity of Emulsion-A immediately after the chemical ripening (for 100 minutes) as 100.

Further, each sample was exposed to light through a pattern for granularity measurement, and subjected to development processing. The thus processed samples were examined for R.M.S. granularity through the density measurement using a microdensitometer (aperture: 48×48 m), according to *Photographic Science and Engineering*, Vol. 19, p. 235 (1975). Granularity at the image density of 1.0 is shown.

| | |
|---|---|
| Developing Solution-A: | |
| 1-Phenyl-3-pyrazolidone | 0.5 g |
| Hydroquinone | 20.0 g |
| Disodium ethylenediaminetetraacetate | 2.0 g |
| Potassium sulfite | 60.0 g |
| Boric acid | 4.0 g |
| Potassium carbonate | 20.0 g |
| Sodium bromide | 5.0 g |
| Diethylene glycol | 30.0 g |
| Water to make | 1 liter |
| pH was adjusted to be 10.0 with NaOH. | |
| Fixing Solution-B: | |
| Ammonium thiosulfate | 200.0 g |
| Sodium sulfite (anhydride) | 20.0 g |
| Boric acid | 8.0 g |
| Disodium ethylenediaminetetraacetate | 0.1 g |
| Aluminium sulfate | 15.0 g |
| Sulfuric acid | 2.0 g |
| Glacial acetic acid | 22.0 g |
| Water to make | 1 liter |
| pH was adjusted to be 4.2. | |

TABLE 1

| | | Coated immediately after chemical ripening | | | Coated after preservation for 4 weeks at 8° C. | | Coated after preservation for 8 hours at 40° C. | |
|---|---|---|---|---|---|---|---|---|
| Emulsion | Contents | Fog | Relative sensitivity | RMS | Fog | Relative sensitivity | Fog | Relative sensitivity |
| A (Comparative) | $H_2O_2$: not added | 0.02 | 100 (standard) | 0.028 | 0.01 | 90 | 0.01 | 95 |
| B (Comparative) | $H_2O_2$: not added | 0.13 | 120 | 0.040 | 0.12 | 115 | 0.16 | 125 |

TABLE 1-continued

| Emulsion | Contents | Coated immediately after chemical ripening | | | Coated after preservation for 4 weeks at 8° C. | | Coated after preservation for 8 hours at 40° C. | |
|---|---|---|---|---|---|---|---|---|
| | | Fog | Relative sensitivity | RMS | Fog | Relative sensitivity | Fog | Relative sensitivity |
| C (Comparative) | $H_2O_2$: added sodium p-toluenesulfinate: not added | 0.02 | 190 | 0.029 | 0.04 | 100 | 0.03 | 120 |
| D (Invention | $H_2O_2$: added sodium p-toluenesulfinate: 1 g/mole-Ag | 0.02 | 190 | 0.029 | 0.02 | 185 | 0.02 | 190 |
| E (Invention | $H_2O_2$: added sodium p-toluenesulfinate: 2 g/mole-Ag | 0.02 | 190 | 0.029 | 0.02 | 190 | 0.02 | 190 |

The results of the Table-1 prove the following facts:

(1) Emulsion-C, Emulsion-D, and Emulsion-E prepared by using hydrogen peroxide were superior to Emulsion-A prepared with no hydrogen peroxide, in that the granularity did not worsen and that the sensitivity was high. The comparative Emulsion-B was not so good, in that the fog was significant and the granularity was bad, although the sensitivity somewhat increased.

(2) Emulsion-C prepared by using hydrogen peroxide alone deteriorates with the lapse of time in that the sensitivity lowers after preserved for a long period of time. Emulsion-D and Emulsion-E prepared by using the combination of hydrogen peroxide and sodium p-toluenesulfinate, in accordance with the present invention, are kept stable with the lapse of time, and therefore these are extremely advantageous in the manufacture of photographic materials, as the materials may be stably manufactured by using Emulsion-D and Emulsion-E of the present invention.

EXAMPLE 2

A reducing agent as shown in the following Table-2 was added to Emulsion-C in Example 1 on the termination of the chemical ripening thereof, in an amount of 5.6 milli-equivalents/mole-Ag. The same additives as those of Example 1 were added and the resulting emulsion was coated on a support. The obtained samples were evaluated, and the results are given in the following Table-2.

TABLE 2

| Reducing agent | Coated immediately after chemical ripening | | Coated after preservation for 4 weeks at 8° C. | | Coated after preservation for 8 hours at 40° C. | |
|---|---|---|---|---|---|---|
| | Fog | Relative sensitivity* | Fog | Relative sensitivity* | Fog | Relative sensitivity* |
| No addition (Emulsion C) | 0.02 | 190 | 0.04 | 100 | 0.03 | 120 |
| Sodium p-toluenesulfinate (Emulsion D) | 0.02 | 190 | 0.02 | 185 | 0.02 | 190 |
| Sodium benzenesulfinate | 0.02 | 190 | 0.02 | 185 | 0.02 | 190 |
| Sodium n-octanesulfinate | 0.02 | 190 | 0.02 | 180 | 0.02 | 185 |
| Resorcinol | 0.02 | 185 | 0.02 | 180 | 0.02 | 180 |
| DL-glucose | 0.03 | 195 | 0.04 | 200 | 0.04 | 195 |
| N-formyl-p-methylhydrazine | 0.04 | 195 | 0.05 | 200 | 0.05 | 200 |
| Dimethylglyoxime | 0.03 | 190 | 0.03 | 195 | 0.03 | 195 |

*based on the sensitivity of Emulsion-A immediately after chemical ripening (for 100 minutes) as being 100.

The results set forth in Table-2 show that the preservation stability of each emulsion is extremely improved by the addition of the reducing agent.

EXAMPLE 3

Potassium bromide and gelatin were dissolved, and a solution of silver nitrate and a mixture solution of potassium bromide and potassium iodide were added to the resulting solution kept at 70° C., while vigorously stirred, by double-jet method, the formed solution being regulated to have pBr value of 1.1. Thus, 5% of the total amount of silver nitrate to be added was first added. The formed emulsion was subjected to physical ripening, and then the remaining silver nitrate solution and a halogen solution were added thereto while pBr was kept to be 1.1. The resulting emulsion was cooled down to 35° C. and soluble salts were removed out therefrom by sedimentation method, and then, the emulsion was again heated up to 40° C. and gelatin was additionally added thereto and the pH value of the emulsion was adjusted to 6.8.

Thus, an emulsion containing tabular silver iodobromide particles was obtained, the particles having an average diameter of 1.52 μm, a thickness of 0.118 μm, a ratio of average diameter/thickness of 12.9/1 and a silver iodide content of 6 mole %.

This emulsion was divided into two parts (one was Emulsion-F, and the other was Emulsion G). The Emulsion-F was ripened with 12 mg/mole-Ag of sodium thiosulfate, 15 mg/mole-Ag of potassium chloroaurate and 320 mg/mole-Ag of potassium thiocyanate, for 100 minutes at 56° C. Emulsion-G was, after 5 cc of 3.5 wt % hydrogen peroxide was added thereto prior to the chemical ripening, ripened with 12 mg/mole-Ag of sodium thiosulfate, 25 mg/mole-Ag of potassium chloroaurate and 320 mg/mole-Ag of potassium thiocyanate, for 100 minutes at 56° C. On the termination of the ripening, 1.0 g/mole-Ag of sodium p-toluenesulfinate was added.

The same additives as in Example 1 were added to the emulsion formed, and this was coated on a support. Thus formed samples were evaluated, and the results are set forth in the following Table-3.

TABLE 3

| Reducing agent | Coated immediately after chemical ripening | | | Coated after preservation for 4 weeks at 8° C. | | Coated after preservation for 8 hours at 40° C. | |
|---|---|---|---|---|---|---|---|
| | Fog | Relative sensitivity | RMS | Fog | Relative sensitivity | Fog | Relative sensitivity |
| F (Comparative) | 0.04 | 100 (standard) | 0.045 | 0.04 | 95 | 0.05 | 105 |
| G | 0.03 | 185 | 0.045 | 0.03 | 190 | 0.03 | 185 |

By the combination use of hydrogen peroxide and sodium p-toluenesulfinate, an emulsion containing tabular particles (in which the content of silver iodide was 6 mole %) was prepared, whose granularity particles did not worsen and sensitivity was high.

EXAMPLE 4

1 g/mole-Ag of sodium p-toluenesulfinate was added to Emulsion-C prepared in Example 1, except that the chemical ripening of the emulsion was changed as shown in Table-4, whereby Emulsion-H, Emulsion-I, and Emulsion-J were obtained.

TABLE 4

| Emulsion | Contents | Time of addition of sodium p-toluenesulfinic acid | Period for chemical ripening: 80 minutes | | 100 minutes | | 120 minutes | |
|---|---|---|---|---|---|---|---|---|
| | | | Fog | Relative sensitivity | Fog | Relative Sensitivity | Fog | Relative Sensitivity |
| A | $H_2O_2$: not added sodium p-toluenesulfinate: not added | — | 0.01 | 90 | 0.02 | 100 (standard) | 0.04 | 110 |
| C | $H_2O_2$: added sodium p-toluenesulfinate: not added | — | 0.01 | 170 | 0.02 | 190 | 0.04 | 130 |
| D | $H_2O_2$: added sodium p-toluenesulfinate: not added | 100 minutes | 0.01 | 170 | 0.02 | 190 | 0.02 | 180 |
| H | " | 1 minute | 0.01 | 170 | 0.02 | 170 | 0.02 | 170 |
| I | " | 30 minutes | 0.01 | 170 | 0.02 | 175 | 0.02 | 180 |
| J | " | 60 minutes | 0.01 | 175 | 0.02 | 180 | 0.02 | 180 |

In Table-4, "time of addition of sodium p-toluenesulfinate" means the time from the beginning of the chemical ripening to the addition of sodium p-toluenesulfinate.

Table-4 shows that Emulsion-D, Emulsion-H, Emulsion-I, and Emulsion-J, obtained according to the method of the present invention, are superior to the comparative Emulsion-A in that the sensitivity is high, that the variation of fog and sensitivity is small with respect to the variation of the time of chemical ripening, and that the emulsions may stably be manufactured. Regarding the time of addition of sodium p-toluenesulfinate, although the sensitivity is somewhat lowered in the case that the reducing agent is added in an initial stage of the chemical ripening, it is noted that the variation of the photographic characteristics of the obtained emulsion to the time of the chemical ripening may be more reduced by the addition of the reducing agent at an earlier stage of the chemical ripening.

While the invention has been described in detail and with reference to specific embodiments thereof, it will be apparent to one skilled in the art that various changes and modifications can be made therein without departing from the spirit and scope thereof.

What is claimed is:

1. A method for preparation of a photographic silver halide emulsion containing tabular silver halide particles having a particle diameter to particle thickness ratio of 5/1 to 50/1, wherein at least one oxidizing agent selected from hydrogen peroxide, a salt of a peroxy acid, and ozone is added to the emulsion before the termination of chemical ripening thereof, and then a reducing agent is added thereto, and wherein the silver halide emulsion is spectrally sensitized.

2. A method for preparation of a photographic silver halide emulsion as in claim 1, wherein the oxidizing agent is an aqueous hydrogen peroxide.

3. A method for preparation of a photographic silver halide emulsion as in claim 1, wherein the oxidizing agent is selected from $NaBO_2.H_2O_2.3H_2O$, $2Na_2CO_3.3H_2O_2$, $Na_4P_2O_7.2H_2O_2$, and $2Na_2SO_4.H_2O_2.2H_2O$.

4. A method for preparation of a photographic silver halide emulsion as in claim 1, wherein the oxidizing agent is a salt of a peroxy acid selected from $K_2S_2O_8$. $K_2C_2O_6$, $K_4P_2O_8$, $K_2[Ti(O_2)C_2O_4].3H_2O$, $4K_2SO_4.Ti(O_2)OH.SO_4.2H_2O$, $Na_3[VO(O_2)(C_2O_4)_2].6H_2O$, and peracetic acid.

5. A method for preparation of a photographic silver halide emulsion as in claim 1, wherein the amount of the oxidizing agent added is from $10^{-6}$ to 10 moles per mole of silver halide.

6. A method for preparation of a photographic silver halide emulsion as in claim 1, wherein the method comprises adding the oxidizing agent to the emulsion during at least one of a precipitation step, a physical ripening step, or a chemical ripening step.

7. A method for preparation of a photographic silver halide emulsion as in claim 6, wherein the method comprises adding the oxidizing agent to the emulsion during a chemical ripening step.

8. A method for preparation of a photographic silver halide emulsion as in claim 1, wherein the method comprises adding a reducing agent capable of deactivating or reducing to the emulsion during or after the chemical ripening step.

9. A method for preparation of a photographic silver halide emulsion as in claim 8, wherein the reducing agent is selected from sulfinic acids, di- or tri-hydroxybenzenes, chromans, tocopherols, hydrazines or hydrazides, p-phenylenediamines, aldehydes, aminophenols, enediols, oximes, reducing sugars, phenidones, sulfites, and hydrogen gas.

10. A method for preparation of a photographic silver halide emulsion as in claim 9, wherein the reducing agent is selected from sulfinic acids, di- or tri-hydroxybenzenes, enediols, oximes and reducing sugars.

11. A method for preparation of a photographic silver halide emulsion as in claim 8, wherein the amount of the reducing agent used is an equimolar amount or more with respect to the oxidizing agent used.

12. A method for preparation of a photographic silver halide emulsion as in claim 1, wherein the tabular silver halide particles have a diameter of from 0.3 to 5.0 μm and a thickness of 0.4 μm or less.

13. A silver halide photographic material including at least one layer comprising a tabular silver halide particle-containing emulsion, where the tabular silver halide particles have a particle diameter to particle thickness ratio of 5/1 to 50/1 and obtained by a method comprising adding at least one oxidizing agent selected from hydrogen peroxide, a salt of a peroxy acid, and ozone to the emulsion before the termination of chemical ripening thereof, and then adding a reducing agent thereto and wherein the silver halide emulsion is spectrally sensitized.

14. A silver halide photographic material as in claim 13, wherein said at least one layer contains 40% by weight or more of the tabular silver halide particles, on the basis of the total weight of silver halide particles.

15. A silver halide photographic material as in claim 13, wherein the thickness of the tabular silver halide particle-containing emulsion layer is from 0.3 to 5.0 μm.

16. A silver halide photographic material as in claim 13, wherein the amount of the oxidizing agent added is from $10^{-6}$ to 10 moles per mole of silver halide.

17. A silver halide photographic material as in claim 13, wherein the oxidizing agent is added to the emulsion during a chemical ripening step.

18. A silver halide photographic material as in claim 13, wherein a reducing agent capable of deactivating or reducing is added to the emulsion during or after the chemical ripening step.

* * * * *